US008033803B2

(12) United States Patent
Stover

(10) Patent No.: US 8,033,803 B2
(45) Date of Patent: Oct. 11, 2011

(54) COMPRESSOR HAVING IMPROVED SEALING ASSEMBLY

(75) Inventor: Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 480 days.

(21) Appl. No.: 12/207,016

(22) Filed: Sep. 9, 2008

(65) Prior Publication Data

US 2009/0087332 A1 Apr. 2, 2009

Related U.S. Application Data

(60) Provisional application No. 60/993,453, filed on Sep. 11, 2007.

(51) Int. Cl.

| | |
|---|---|
| ***F04C 18/04*** | (2006.01) |
| ***F01C 19/00*** | (2006.01) |
| ***F01C 1/04*** | (2006.01) |
| ***F16J 9/12*** | (2006.01) |

(52) U.S. Cl. ..... 418/55.4; 418/55.1; 418/55.5; 418/57; 277/491

(58) Field of Classification Search ..... 418/55.1, 418/55.4, 55.5, 55.2, 57; 277/491
See application file for complete search history.

(56) References Cited

U.S. PATENT DOCUMENTS

| | | | | |
|---|---|---|---|---|
| 5,281,114 | A | 1/1994 | Bush | |
| 5,447,418 | A | 9/1995 | Takeda et al. | |
| 5,863,191 | A * | 1/1999 | Motegi et al. | 418/55.1 |
| 6,095,764 | A | 8/2000 | Shibamoto et al. | |
| 6,113,373 | A * | 9/2000 | Fukuhara et al. | 418/55.4 |
| 6,419,457 | B1 | 7/2002 | Seibel et al. | |
| 6,679,683 | B2 | 1/2004 | Seibel et al. | |
| 7,074,013 | B2 | 7/2006 | Seibel et al. | |
| 7,300,265 | B2 * | 11/2007 | Stover | 418/55.5 |
| 7,553,140 | B2 * | 6/2009 | Stover | 418/55.5 |
| 2005/0201883 | A1 * | 9/2005 | Clendenin et al. | 418/55.5 |

(Continued)

FOREIGN PATENT DOCUMENTS

| | | |
|---|---|---|
| JP | 07063173 | 3/1995 |

(Continued)

OTHER PUBLICATIONS

International Search Report regarding International Application No. PCT/US2008/010622 dated Feb. 24, 2009.

(Continued)

*Primary Examiner* — Mary A Davis
(74) *Attorney, Agent, or Firm* — Harness, Dickey & Pierce, P.L.C.

(57) ABSTRACT

A compressor may include a shell, a bearing housing assembly located within and secured to the shell, a compression mechanism supported on the bearing housing assembly, a partition extending over the compression mechanism, and an annular seal assembly. The partition may be fixed to the shell and may abut an axial end surface of the bearing housing assembly to control a maximum axial distance between the partition and the compression mechanism. The annular seal may be sealingly engaged with the compression mechanism and the bearing housing assembly and may have a generally L-shaped cross-section including a first leg extending generally laterally between the compression mechanism and the partition. The first leg may have an axial thickness that is greater than the maximum axial distance.

26 Claims, 4 Drawing Sheets

U.S. PATENT DOCUMENTS

| | | | | |
|---|---|---|---|---|
| 2006/0198748 | A1* | 9/2006 | Grassbaugh et al. | 418/55.1 |
| 2006/0204379 | A1 | 9/2006 | Seibel et al. | |
| 2006/0204380 | A1 | 9/2006 | Seibel et al. | |
| 2006/0245968 | A1* | 11/2006 | Gopinathan et al. | 418/55.1 |
| 2007/0059192 | A1* | 3/2007 | Stover | 418/55.1 |

FOREIGN PATENT DOCUMENTS

| | | |
|---|---|---|
| JP | 08261176 | 10/1996 |
| JP | 09317667 | 12/1997 |
| JP | 11022660 | 1/1999 |
| JP | 11182462 | 7/1999 |
| JP | 2001082354 | 3/2001 |
| JP | 2003065255 | 3/2003 |
| KR | 1019950006252 | 3/1995 |
| KR | 1019990060803 | 7/1999 |
| KR | 1020010035761 | 5/2001 |
| KR | 1020020030018 | 4/2002 |

OTHER PUBLICATIONS

Written Opinion of the International Searching Authority regarding International Application No. PCT/US2008/010622 dated Feb. 24, 2009.

International Search Report regarding International Application No. PCT/US2008/010623 dated Feb. 26, 2009.

Written Opinion of the International Searching Authority regarding International Application No. PCT/US2008/010623 dated Feb. 26, 2009.

International Search Report regarding International Application No. PCT/US2008/010597 dated Feb. 19, 2009.

Written Opinion of the International Searching Authority regarding International Application No. PCT/US2008/010597 dated Feb. 19, 2009.

International Preliminary Report on Patentability regarding International Application No. PCT/US2008/010622 dated Mar. 16, 2010.

* cited by examiner

COMPRESSOR HAVING IMPROVED SEALING ASSEMBLY

CROSS-REFERENCE TO RELATED APPLICATIONS

This application claims the benefit of U.S. Provisional Application No. 60/993,453, filed on Sep. 11, 2007. The entire disclosure of the above application is incorporated herein by reference.

FIELD

The present disclosure relates to compressors, and more specifically to a seal arrangement for a compressor.

BACKGROUND

This section provides background information related to the present disclosure which is not necessarily prior art.

Compressors may include a sealing arrangement to isolate differing pressure regions from one another. During compressor operation, pressure fluctuations may cause the sealing arrangement to be displaced, resulting in a leak path being formed between the differing pressure regions. More significant pressure fluctuations may result in a seal being deformed or otherwise damaged.

SUMMARY

This section provides a general summary of the disclosure, and is not a comprehensive disclosure of its full scope or all of its features.

A compressor may include a shell, a bearing housing assembly located within and secured to the shell, a compression mechanism supported on the bearing housing assembly, a partition extending over the compression mechanism, and an annular seal assembly. The partition may be fixed to the shell and may abut an axial end surface of the bearing housing assembly to control a maximum axial distance between the partition and the compression mechanism. The annular seal may be sealingly engaged with the compression mechanism and the bearing housing assembly and may have a generally L-shaped cross-section including a first leg extending generally laterally between the compression mechanism and the partition. The first leg may have an axial thickness that is greater than the maximum axial distance.

The compression mechanism may include first and second scroll members meshingly engaged with one another, the first scroll member being axially displaceable a predetermined distance relative to the partition. The first scroll member may include a non-orbiting scroll member. The partition may limit axial displacement of the first scroll member in a first direction and the bearing housing may limit axial displacement of the first scroll member in a second direction. The second scroll member may be disposed axially between the first scroll member and the bearing housing, the first scroll member abutting the second scroll member in the second position.

The first scroll member may additionally include an end plate having an annular wall extending axially therefrom in a direction toward the partition, an axially outer end of the annular wall being spaced the predetermined distance from the partition when the first scroll member is axially displaced the predetermined distance axially outwardly from the partition. The first leg may include an axial thickness that is greater than the predetermined distance. The predetermined distance may define the maximum axial distance. The wall may be located radially inwardly relative to the annular seal and may limit radially inward displacement of the annular seal. The wall may be located radially outwardly relative to the annular seal and may limit radially outward displacement of the annular seal.

The first scroll member may additionally include a radially outwardly extending flange having an opening therethrough, the bearing housing assembly including an axially extending member extending through the opening to guide axial displacement of the first scroll member. The portion of the flange defining the opening may extend radially outwardly relative to a portion of the axially extending member to limit rotation of the first scroll member relative to the bearing housing.

The partition may include first and second portions, the first portion extending laterally above the compression mechanism and defining the second discharge passage, the second portion located radially outwardly relative to the first portion and extending axially toward and abutting the bearing housing. The second portion may generally surround a radially outer portion of the compression mechanism.

A compressor may alternatively include a shell and a bearing housing assembly located within the shell and secured relative thereto. A compression mechanism may be supported within the shell on the bearing housing assembly and may include a first discharge passage. A partition may extend over the compression mechanism and may include a second discharge passage in communication with the first discharge passage, the partition being fixed to the shell and abutting an axial end surface of the bearing housing assembly to control a maximum axial distance between the partition and the compression mechanism. A first annular seal may be located in a discharge pressure region of the compressor and may be disposed around the first and second discharge openings and sealingly engaged with the compression mechanism and the partition to isolate the discharge pressure region from a lower pressure region of the compressor. The maximum axial distance may prevent radial displacement of the first annular seal beyond a first predetermined location.

The first annular seal may include a minimum axial thickness region having an axial thickness that is greater than the maximum axial thickness. The minimum axial thickness region may prevent radial displacement of the annular seal beyond the first predetermined location. The compression mechanism may include a side wall, the first annular seal being sealingly engaged with the side wall and the partition, the maximum axial distance being defined between an end of the side wall and the partition to prevent radial displacement of the first annular seal radially outward from the side wall.

The second annular seal may be disposed around the first annular seal and may be sealingly engaged with the compression mechanism and the partition. The first and second annular seals, the partition, and the compression mechanism may define a biasing chamber isolated from the discharge pressure region and a suction pressure region of the compressor.

The maximum axial distance may prevent radial displacement of the second annular seal beyond a second predetermined location.

The compression mechanism may additionally include a side wall, the second annular seal being sealingly engaged with the side wall and the partition, the maximum axial distance being defined between an end of the side wall and the partition to prevent radial displacement of the second annular seal radially outward from the side wall. The compression mechanism may additionally include a non-orbiting scroll member, the first annular seal being sealingly engaged with the non-orbiting scroll member.

A method may include securing a bearing housing assembly within a shell of a compressor and locating a compression mechanism on the bearing housing assembly. An annular seal may be located around a first discharge passage in the compression mechanism. A partition may be secured to the shell such that the partition overlies the compression mechanism and abuts an axial end surface of the bearing housing assembly to control a maximum axial distance between the partition and the compression mechanism, the annular seal having a generally L-shaped cross-section including a first leg extending generally laterally between the compression mechanism and the partition after the partition is secured to the shell, the first leg having an axial thickness that is greater than the maximum axial distance. The partition may be secured a predetermined axial distance from the partition and the bearing housing assembly independent of the location of the bearing housing assembly within the shell. The compression mechanism may include first and second scroll members. The first scroll member may be secured for limited axial displacement relative to the bearing housing assembly. A predetermined axial spacing between the partition and the first scroll member may define the maximum axial distance. The first scroll member may be a non-orbiting scroll member.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Figure 1:
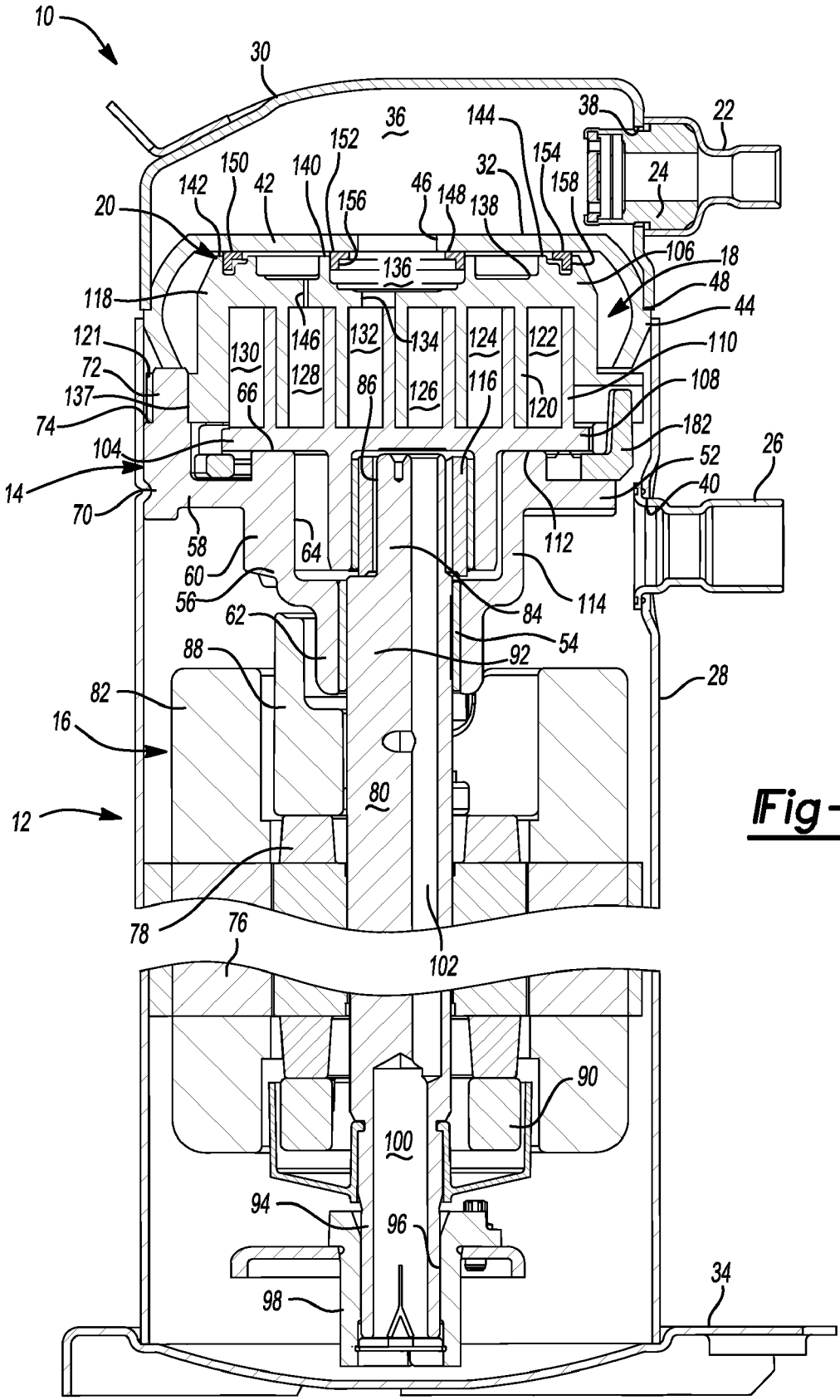
FIG. 1 is a sectional view of a compressor according to the present disclosure.
Figure 4:
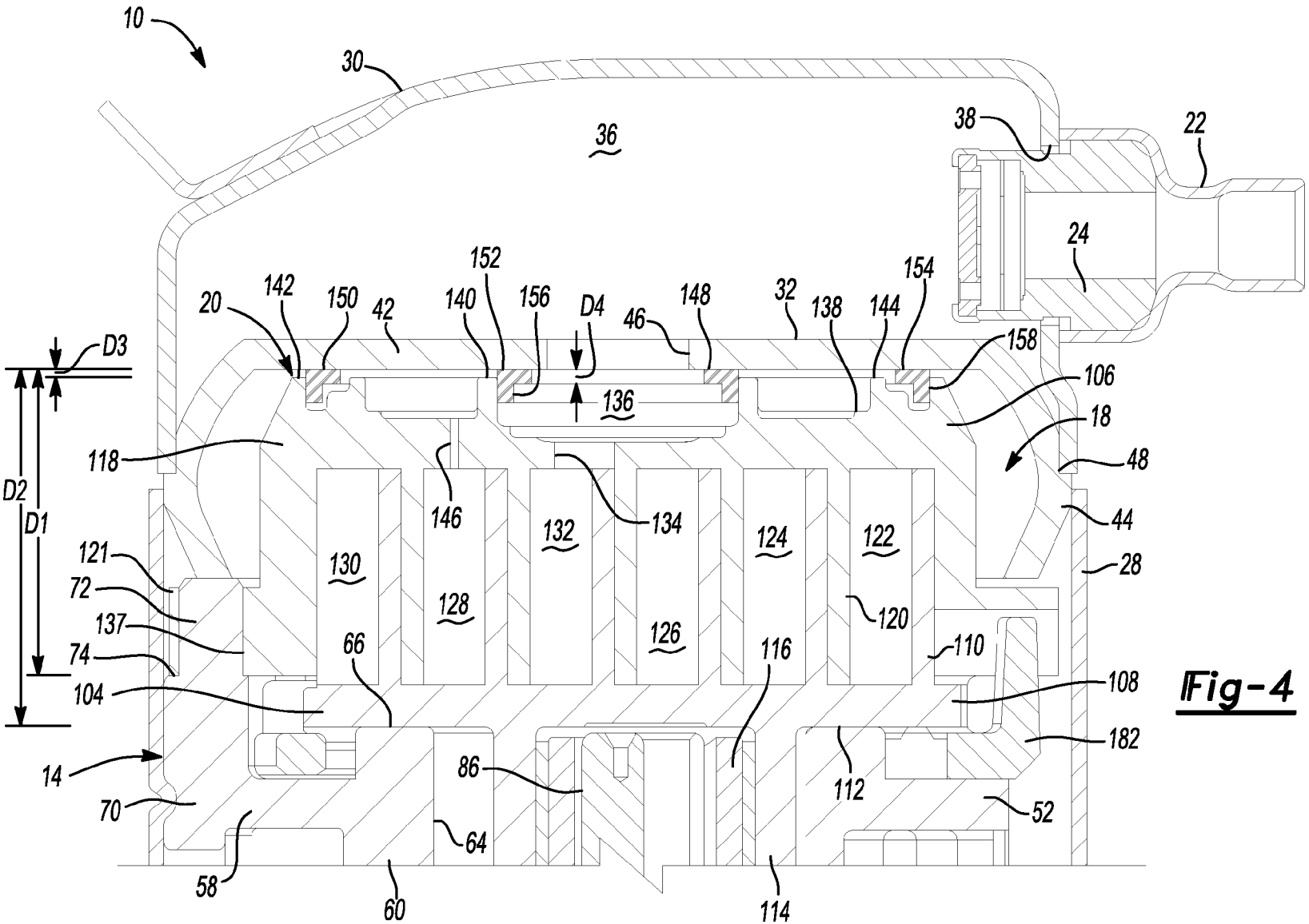
FIG. 4 is a fragmentary section view of the compressor of FIG. 1.

With reference to FIGS. 1 and 4, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, and a suction gas inlet fitting 26. Shell assembly 12 may house main bearing housing assembly 14, motor assembly 16, and compression mechanism 18.

Shell assembly 12 may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Suction gas inlet fitting 26 may be attached to shell assembly 12 at opening 40.

Partition 32 may include first and second portions 42, 44. First portion 42 may extend laterally and may include a discharge passage 46 therethrough. Second portion 44 may extend axially outwardly from first portion 42. Second portion 44 may extend into and abut shell 28 at a radially outer surface of second portion 44. Second portion 44 may be fixed to shell 28 in a variety of ways including welding. Second portion 44 may include a stepped region 48 in the radially outer surface thereof at a location axially outwardly relative to shell 28, forming a mounting location for end cap 30.

Figure 2:
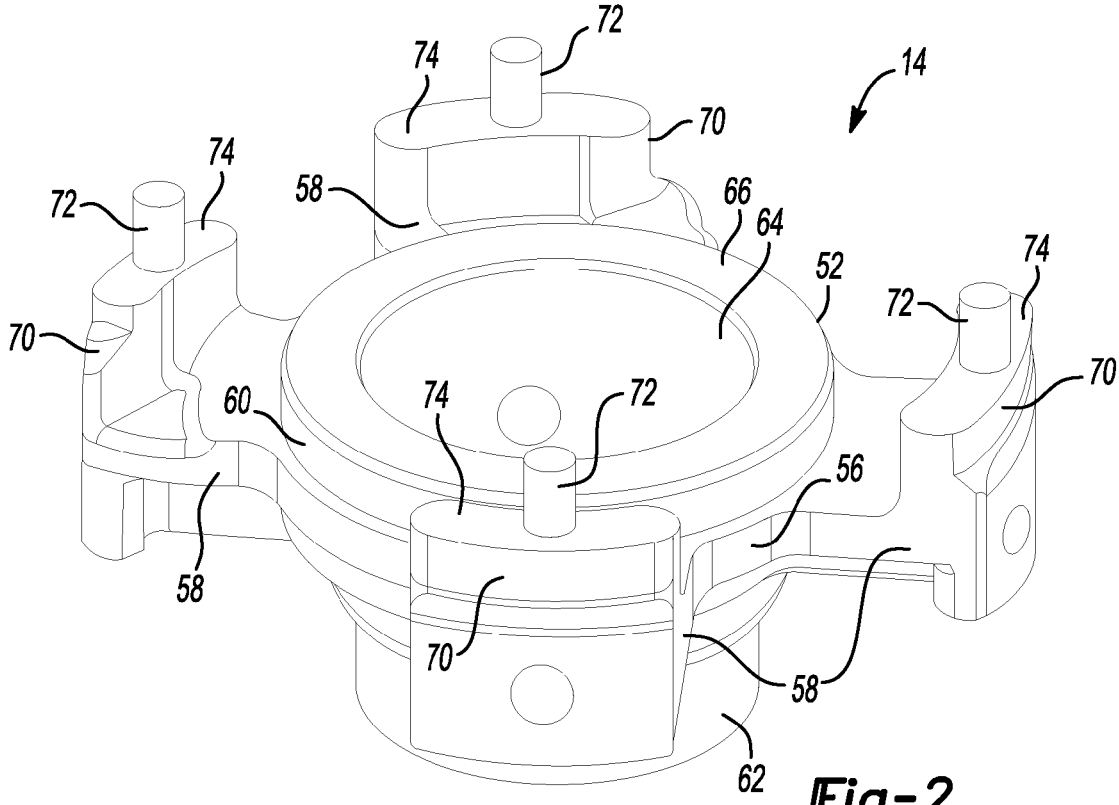
FIG. 2 is a perspective view of a main bearing housing of the compressor of FIG. 1.

With additional reference to FIG. 2, main bearing housing assembly 14 may be affixed to shell 28 at a plurality of points in any desirable manner, such as staking. Main bearing housing assembly 14 may include a main bearing housing 52 having a first bearing 54 disposed therein. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof.

Arm 58 may include first and second portions 70, 72 extending axially toward partition 32. First portion 70 may abut shell 28. Second portion 72 may extend from an axial end of first portion 70 and may be spaced radially inwardly from shell 28. Second portion 72 may have a circumferential and/or a radial extent (or width) that is less than a circumferential and/or a radial extent (or width) of first portion 70, forming a step 74 between first and second portions 70, 72.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80.

Drive shaft 80 may include an eccentric crank pin 84 having a flat 86 thereon and upper and lower counter-weights 88, 90. Drive shaft 80 may include a first journal portion 92 rotatably journaled in first bearing 54 in main bearing housing 52 and a second journal portion 94 rotatably journaled in a second bearing 96 in a lower bearing housing 98. Drive shaft 80 may include an oil-pumping concentric bore 100 at a lower end. Concentric bore 100 may communicate with a radially outwardly inclined and relatively smaller diameter bore 102 extending to the upper end of drive shaft 80. The lower interior portion of shell assembly 12 may be filled with lubricating oil. Concentric bore 100 may provide pump action in conjunction with bore 102 to distribute lubricating fluid to various portions of compressor 10.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement.

Figure 3:
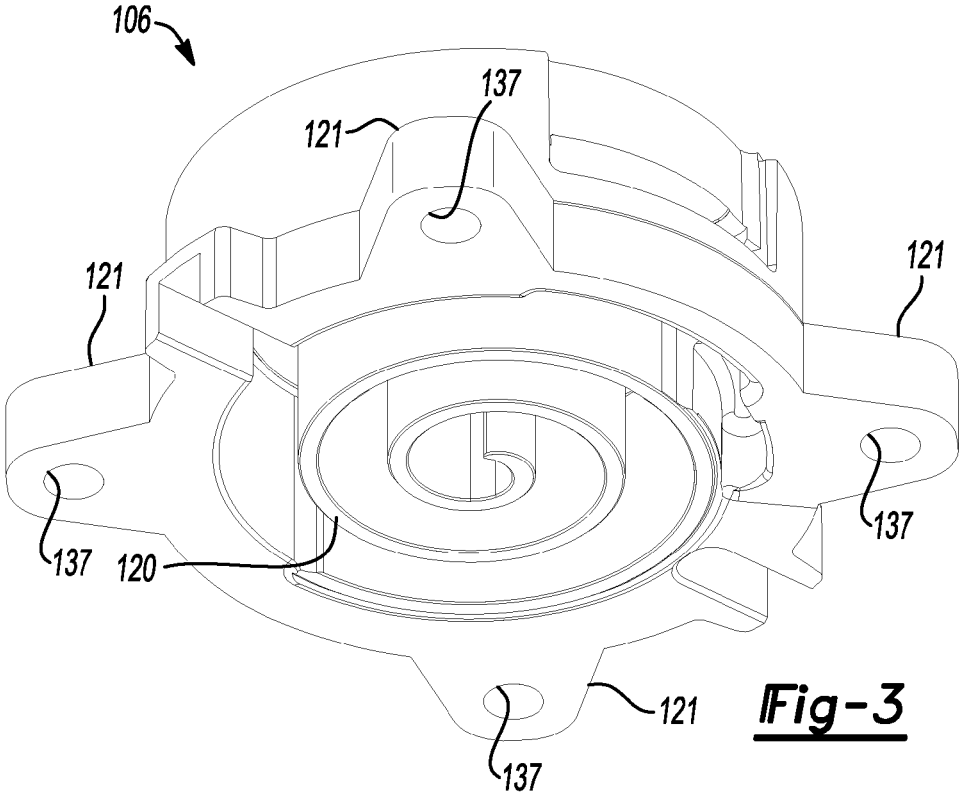
FIG. 3 is a perspective view of a non-orbiting scroll of the compressor of FIG. 1.

With reference to FIGS. 1, 3, and 4, non-orbiting scroll 106 may include an end plate 118 having a spiral wrap 120 on a lower surface thereof and a series of radially outwardly extending flanged portions 121. Spiral wrap 120 may form a meshing engagement with wrap 110 of orbiting scroll 104, thereby creating an inlet pocket 122, intermediate pockets 124, 126, 128, 130, and an outlet pocket 132. Non-orbiting scroll 106 may be axially displaceable relative to main bearing housing assembly 14, shell assembly 12, and orbiting scroll 104. Non-orbiting scroll 106 may include a discharge passage 134 in communication with outlet pocket 132 and upwardly open recess 136 which may be in fluid communication with discharge chamber 36 via discharge passage 46 in partition 32.

Flanged portions 121 may include openings 137 therethrough. Opening 137 may receive second portion 72 of arm 58 therein. Arm 58 may generally form a guide for axial displacement of non-orbiting scroll 106. Arm 58 may additionally prevent rotation of non-orbiting scroll 106 relative to main bearing housing assembly 14.

Figure 5:
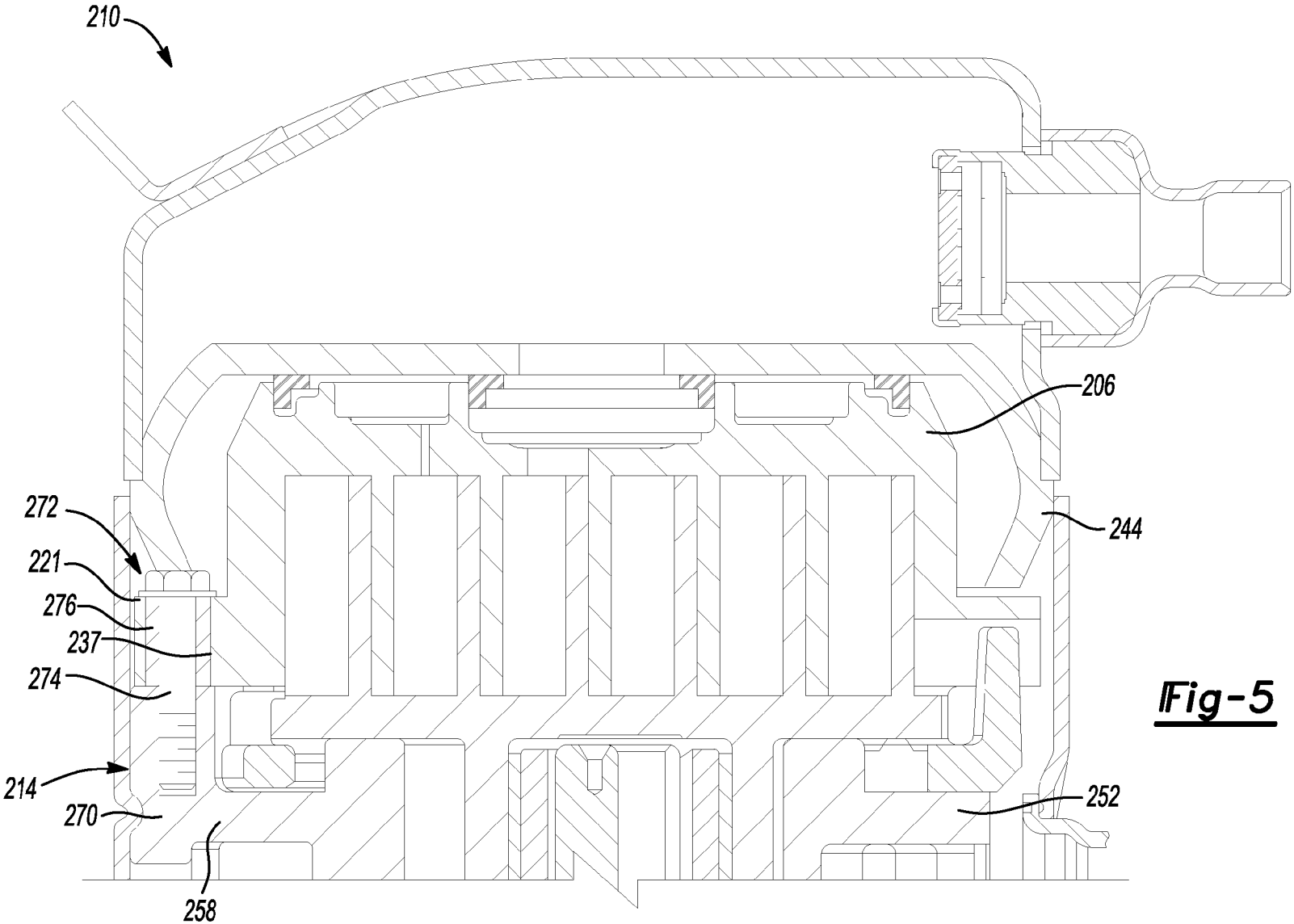
FIG. 5 is a fragmentary section view of an alternate compressor according to the present disclosure.

While second portion 72 of arm 58 is shown securing non-orbiting scroll 106 relative to main bearing housing assembly 14, it is understood that a variety of other attachment methods may alternatively be employed. For example, as seen in FIG. 5, an alternate main bearing housing assembly 214 may include a main bearing housing 252 and a fastener assembly 272. Fastener assembly 272 may include a bolt 274 and a bushing 276. Bushing 276 may be disposed within opening 237 of flanged portion 221 and may abut first portion 270 of arm 258. Bolt 274 may pass through bushing 276 and may engage first portion 270 of arm 258, retaining non-orbiting scroll 206 relative thereto. It is understood that the description of compressor 10 applies equally to compressor 210 with the exception of portions discussed above.

Non-orbiting scroll 106 may include an annular recess 138 in the upper surface thereof defined by parallel coaxial inner and outer side walls 140, 142. A medial side wall 144 may be parallel to and coaxial with inner and outer side walls 140, 142 and disposed radially therebetween. Annular recess 138 may provide for axial biasing of non-orbiting scroll 106 relative to orbiting scroll 104, as discussed below. More specifically, a passage 146 may extend through end plate 118 of non-orbiting scroll 106, placing recess 138 in fluid communication with intermediate pocket 128. While passage 146 is shown extending into intermediate pocket 128, it is understood that passage 146 may alternatively be placed in communication with any of the other intermediate pockets 124, 126, 130.

With reference to FIGS. 1 and 4, seal assembly 20 may include first and second annular seals 148, 150. First and second annular seals 148, 150 may each be engaged with non-orbiting scroll 106 and partition 32 to form a biasing chamber. First and second annular seals 148, 150 may each include a first leg 152, 154 and a second leg 156, 158, forming L-shaped cross-sections. However, it is understood that the present disclosure is in no way limited to seals having L-shaped cross-sections. In the present non-limiting example, first annular seal 148 may be sealingly engaged with inner side wall 140 and partition 32 to form a sealed discharge passage between discharge passage 134 in non-orbiting scroll 106 and discharge passage 46 in partition 32 and to isolate recess 138 in non-orbiting scroll 106 from discharge pressure. More specifically, first leg 152 of first annular seal 148 may extend laterally between partition 32 and non-orbiting scroll 106 and may be sealingly engaged with partition 32. Second leg 156 may extend axially inwardly from first leg 152 and may be sealingly engaged with a radially inner surface of inner side wall 140.

Second annular seal 150 may be located between outer side wall 142 and medial side wall 144. Second annular seal 150 may be sealingly engaged with outer side wall 142 and partition 32 to isolate recess 138 in non-orbiting scroll 106 from suction pressure. More specifically, first leg 154 of second annular seal 150 may extend laterally between partition 32 and non-orbiting scroll 106 and may be sealingly engaged with partition 32. Second leg 158 may extend axially inwardly from first leg 154 and may be sealingly engaged with a radially inner surface of outer side wall 142.

Partition 32 and main bearing housing assembly 14 may cooperate to locate partition 32 relative to non-orbiting scroll 106. More specifically, partition 32 may be located relative to non-orbiting scroll 106 to radially retain first and second annular seals 148, 150.

With reference to FIGS. 1 and 4, first portion 42 of partition 32 may extend laterally over non-orbiting scroll 106 and second portion 44 may extend axially toward main bearing housing assembly 14 and along an axial extent of non-orbiting scroll 106. An end of second portion 44 may abut main bearing housing assembly 14, locating partition 32 relative thereto. More specifically, second portion 44 may abut second portion 72 of arm 58 of main bearing housing 52. Alternatively, second portion 244 may abut a fastener, such as bolt 274 in the main bearing housing assembly 214 of FIG. 5. In either configuration, partition 32, 232 may be directly axially located relative to main bearing housing assembly 14, 214 through direct engagement therewith.

An axial distance (D1) may be defined between step 74 of main bearing housing 52 and first portion 42 of partition 32 and a distance (D2) may be defined between thrust bearing surface 66 and first portion 42 of partition 32. Distances (D1, D2) may be defined solely by an axial extent of main bearing housing 52 and an axial extent of second portion 44 of partition 32. More specifically, distance (D1) may be defined solely by an axial extent of second portion 72 and second portion 44. Distance (D2) may be defined solely by an axial extent of main bearing housing 52 relative to thrust bearing surface 66 and second portion 44.

Non-orbiting scroll 106 may be axially retained between partition 32 and main bearing housing 52 within the region defined by distance (D1). Non-orbiting scroll 106 may be displaceable between first and second positions. The first position (seen in FIGS. 1 and 4) may generally correspond to an axially outermost position of non-orbiting scroll 106 relative to first portion 42 of partition 32 and the second position may generally correspond to an axially innermost location of non-orbiting scroll 106 relative to first portion 42 of partition 32.

In the first position, flanged portion 121 of non-orbiting scroll 106 may generally abut step 74 of main bearing housing 52. Alternatively, or additionally, non-orbiting scroll 106 may abut orbiting scroll 104, which abuts main bearing housing 52. In either configuration, main bearing housing 52 may generally limit axially outward displacement of non-orbiting scroll 106 relative to first portion 42 of partition 32. Since partition 32 directly abuts main bearing housing assembly 14, the distance between non-orbiting scroll 106 and first portion 42 of partition 32 may be controlled directly by the engagement between main bearing housing assembly 14 and partition 32 and independently from the location of main bearing housing assembly 14 within shell 28.

With reference to FIG. 4, the relationship between partition 32 and non-orbiting scroll 106 in the first position is illustrated. Non-orbiting scroll 106 may be axially spaced a maximum distance (D3) relative to first portion 42 of partition 32. More specifically, axially outer ends of inner and outer side walls 140, 142 and medial side wall 144 may be spaced distance (D3) from first portion 42. First and second annular seals 148, 150 may each have a minimum axial thickness region having an axial thickness (D4) greater than the maximum distance (D3). The minimum axial thickness regions (D3) may prevent outward radial displacement of the first annular seal 148 beyond a first predetermined location and may prevent outward radial displacement of the second annular seal 150 beyond a second predetermined location.

By way of non-limiting example, first legs 152, 154 of first and second annular seals 148, 150 may each have an axial thickness (D4) that is greater than distance (D3). Therefore, inner, outer, and medial side walls 140, 142, 144 may limit radial displacement of first and second annular seals 148, 150. More specifically, inner side wall 140 may limit radially outward displacement of first annular seal 148. Outer side wall 142 may limit radially outward displacement of second annular seal 150 and medial side wall 144 may limit radially inward displacement of second annular seal 150.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a bearing housing assembly located within said shell and secured relative thereto;

a compression mechanism supported within said shell on said bearing housing assembly and including a first discharge passage;

a partition extending over said compression mechanism and including a second discharge passage in communication with said first discharge passage, said partition fixed to said shell and abutting an axial end surface of said bearing housing assembly to control a maximum axial distance between said partition and said compression mechanism; and an annular seal disposed around said first and second discharge passages and sealingly engaged with said compression mechanism and said partition, said annular seal having a generally L-shaped cross-section including a first leg extending generally laterally between said compression mechanism and said partition, said first leg having an axial thickness that is greater than said maximum axial distance.

2. The compressor of claim 1, wherein said compression mechanism includes first and second scroll members meshingly engaged with one another, said first scroll member being axially displaceable a predetermined distance relative to said partition.

3. The compressor of claim 2, wherein said first scroll member includes a non-orbiting scroll member.

4. The compressor of claim 2, wherein said partition limits axial displacement of said first scroll member in a first direction and said bearing housing limits axial displacement of said first scroll member in a second direction.

5. The compressor of claim 4, wherein said second scroll member is disposed axially between said first scroll member and said bearing housing and said second scroll member abuts said first scroll member and said bearing housing to limit axial displacement in the second direction.

6. The compressor of claim 2, wherein said first scroll member includes an end plate having an annular wall extending axially therefrom in a direction toward said partition, an axially outer end of said annular wall being spaced said predetermined distance from said partition when said first scroll member is axially displaced said predetermined distance axially outwardly from said partition.

7. The compressor of claim 6, wherein said axial thickness is greater than said predetermined distance.

8. The compressor of claim 6, wherein said predetermined distance defines said maximum axial distance.

9. The compressor of claim 6, wherein said annular wall is located radially inwardly relative to said annular seal and limits radially inward displacement of said annular seal.

10. The compressor of claim 6, wherein said annular wall is located radially outwardly relative to said annular seal and limits radially outward displacement of said annular seal.

11. The compressor of claim 2, wherein said first scroll member includes a radially outwardly extending flange having an opening therethrough, said bearing housing assembly including an axially extending member extending through said opening to guide axial displacement of said first scroll member.

12. The compressor of claim 11, wherein a portion of said flange defining said opening extends radially outwardly relative to a portion of said axially extending member to limit rotation of said first scroll member relative to said bearing housing.

13. The compressor of claim 1, wherein said partition includes first and second portions, said first portion extending laterally above said compression mechanism and defining said second discharge passage, said second portion located radially outwardly relative to said first portion and extending axially toward and abutting said bearing housing.

14. The compressor of claim 13, wherein said second portion generally surrounds a radially outer portion of said compression mechanism.

15. A compressor comprising:

a shell;

a bearing housing assembly located within said shell and secured relative thereto;

a compression mechanism supported within said shell on said bearing housing assembly and including a first discharge passage;

a partition extending over said compression mechanism and including a second discharge passage in communication with said first discharge passage, said partition fixed to said shell and abutting an axial end surface of said bearing housing assembly to control a maximum axial distance between said partition and said compression mechanism; and a first annular seal located in a discharge pressure region of the compressor and disposed around said first and second discharge passages and sealingly engaged with said compression mechanism and said partition to isolate said discharge pressure region from a lower pressure region of the compressor, said first annular seal biased axially into engagement with said partition by discharge pressure and said first annular seal includes a minimum axial thickness region having an axial thickness that is greater than said maximum axial thickness, said minimum axial thickness region and said maximum axial distance preventing radial displacement of said first annular seal beyond said first predetermined location.

16. The compressor of claim 15, wherein said compression mechanism includes a side wall, said first annular seal being sealingly engaged with said side wall and said partition, said maximum axial distance being defined between an end of said side wall and said partition to prevent radial displacement of said first annular seal radially outward from said side wall.

17. The compressor of claim 15, further comprising a second annular seal disposed around said first annular seal and sealingly engaged with said compression mechanism and said partition, said first and second annular seals, said partition, and said compression mechanism defining a biasing chamber isolated from said discharge pressure region and a suction pressure region of the compressor and said second annular seal biased axially into engagement with said partition by intermediate pressure within said biasing chamber.

18. The compressor of claim 17, wherein said maximum axial distance prevents radial displacement of said second annular seal beyond a second predetermined location.

19. The compressor of claim 17, wherein said compression mechanism includes a side wall, said second annular seal being sealingly engaged with said side wall and said partition, said maximum axial distance being defined between an end of said side wall and said partition to prevent radial displacement of said second annular seal radially outward from said side wall.

20. The compressor of claim 15, wherein said compression mechanism includes a non-orbiting scroll member, said first annular seal being sealingly engaged with said non-orbiting scroll member.

21. A method comprising:

securing a bearing housing assembly within a shell of a compressor;

locating a compression mechanism on the bearing housing assembly;

locating an annular seal around a first discharge passage in the compression mechanism; and securing a partition to the shell such that the partition overlies the compression mechanism and abuts an axial end surface of the bearing housing assembly to control a maximum axial distance between the partition and the compression mechanism, the annular seal having a generally L-shaped cross-section including a first leg extending generally laterally between the compression mechanism and the partition after the partition is secured to the shell, the first leg having an axial thickness that is greater than the maximum axial distance.

22. The method of claim 21, wherein said securing the partition defines a predetermined axial distance between the partition and the bearing housing assembly independent of the location of the bearing housing assembly within the shell.

23. The method of claim 21, wherein the compression mechanism includes first and second scroll members.

24. The method of claim 23, further comprising securing the first scroll member for limited axial displacement relative to the bearing housing assembly.

25. The method of claim 24, wherein said securing the partition provides a predetermined axial spacing between the partition and the first scroll member defining the maximum axial distance.

26. The method of claim 25, wherein the first scroll member is a non-orbiting scroll member.

* * * * *